United States Patent [19]

DeJager et al.

[11] 4,428,286

[45] Jan. 31, 1984

[54] BAND POSITIONING APPARATUS

[75] Inventors: James DeJager; Leonard Ward, both of Melbourne, Fla.

[73] Assignee: Storage Technology Corporation, Louisville, Colo.

[21] Appl. No.: 341,574

[22] Filed: Jan. 21, 1982

Related U.S. Application Data

[63] Continuation of Ser. No. 149,970, May 15, 1980, abandoned, which is a continuation of Ser. No. 731,655, Oct. 12, 1976, abandoned.

[51] Int. Cl.[3] ..... B41J 1/60

[52] U.S. Cl. ..... 101/111; 400/146

[58] Field of Search ..... 101/111, 93.13, 93.14; 400/133, 146; 178/23 R

[56] References Cited

U.S. PATENT DOCUMENTS

| | | | |
|---|---|---|---|
| 3,665,850 | 5/1972 | Berger et al. | 101/93.13 |
| 3,828,669 | 8/1974 | Bonafino et al. | 101/111 |
| 3,899,968 | 8/1975 | McDevitt | 101/111 |
| 3,983,804 | 10/1976 | Thienemann | 101/111 |
| 3,999,478 | 12/1976 | Holzman | 101/111 |
| 4,006,682 | 2/1977 | Chambolle | 101/111 |
| 4,074,068 | 2/1978 | Wada et al. | 178/23 R |
| 4,075,945 | 2/1978 | Bienholz | 400/146 |

*Primary Examiner*—E. H. Eickholt

*Attorney, Agent, or Firm*—Duckworth, Allen, Dyer & Pettis

[57] ABSTRACT

This invention relates to a system for positioning a high-speed endless loop printing band of the type used on impact band printers. The band positioning apparatus includes a first sensor for being placed adjacent the edge of the endless loop band for detecting the drift of the edge to one side of a reference line. A second sensor is provided adjacent an area of the endless loop printing band for detecting the drift of the edge to the other side of the reference line. A microprocessor is coupled to the first and second sensors for generating a correcting output signal to a step motor. The step motor is coupled to a pulley in guiding communication with the endless loop printing band for displacing the pulley toward the reference line, thereby correcting the undesired movement of the edge of the endless loop printing band.

20 Claims, 4 Drawing Figures

BAND POSITIONING APPARATUS

This is a continuation, of application Ser. No. 149,970 filed 05/15/80, which is a continuation of application Ser. No. 731,655 filed on 10/12/76 both now abandoned.

BACKGROUND OF THE INVENTION

I. Field of the Invention

This invention relates generally to computer output terminals of the type using an endless loop band having characters thereon for being impacted by a hammer for printing the character upon a paper surface adjacent thereto. In particular, this invention relates to an apparatus for controlling the elevation of the endless loop printing band for controlling the vertical spacing between adjacent printed lines.

II. Description of the Prior Art

Various prior art systems have been utilized for locating the position of a moving element relative to a reference position. Brown in U.S. Pat. No. 3,431,425 discloses a sensing system using dual light emitting elements for generating an error signal which is used to control a two phase servo motor, which then energizes a hydraulic valve control positioning mechanism to realign the traveling printing web. This system uses AC signals throughout for controlling a servo motor as opposed to the use of DC torque motors or stepping motors. Rempert in U.S. Pat. No. 3,598,978 discloses a method and apparatus for locating a preferred position on a workpiece. The workpiece is moved first in one direction and then in the opposite direction to determine with the aid of a light sensing element the distances between the initial position of the light sensing element and two of the workpiece edges.

Bessonny and Bowen in U.S. Pat. No. 3,432,672 disclose an automatic web registration control for use in printing presses. The control system employs a pair of photocells spaced apart by the distance equal to the separation between a pair of indicia. Pulse generation circuits are coupled to the photocells for generating paired pulses of opposite polarity, with the duration of the pulses being different when the web is out of registration. Mechanical means are provided for adjusting the position of the web responsive to the pulserations. Schneider in U.S. Pat. No. 3,525,872 discloses a system for detecting the arrival of a register mark on material traveling along a longitudinal axis, and responsive thereto generates a first control signal for triggering the performance of a work function on the work piece at a point in registration with the registration with the reference point. Hall and Beddell in U.S. Pat. No, 3,956,632 disclose a control system utilizing dual photoelectric sensors spaced on opposite sides of a longitudinally moving conveyor. Control signals are generated responsive to a transverse movement of the conveyor for reorienting the guiding sensors. Scanlon in U.S. Pat. No. 3,395,285 discloses a pinhole detector which automatically inspects very thin sheets of metal for minute perforations.

In contrast with these analog prior art systems, the present invention utilizes two pairs of optical sensors located adjacent to at least one edge of the moving printing band. The optical sensors could be placed adjacent opposite edges of the printing band if the variation in the width of the printing band were small with respect to the allowed position variation. The analog output signals from these sensors are then digitized to be input compatible with a digital computer which compares the sensor signals with a predetermined logic pattern. The digital computer generates a digital correction signal which operates a digital step motor for moving the printing band in incremental steps to correct the positioning error.

SUMMARY OF THE INVENTION

This invention relates to a band positioning apparatus for vertically positioning a high-speed endless loop printing band of the type used on impact band printers. The band positioning apparatus comprises a first sensor for generating, at an output thereof, a first signal responsive to the edge of the endless loop printing band drifting to one side of a reference line, with the reference line being defined by the correct position of the edge of the endless loop printing band. A second sensor is provided for generating, at an output thereof, a second signal responsive to the edge of the endless loop printing band drifting to the other side of the reference line. A microprocessor type computer is provided for receiving the first and second signal and for generating a correction signal responsive thereto. Step motor means are actuated responsive to the correction signals for moving the edge of the endless loop printing band toward the reference line.

The band positioning apparatus further includes conditioning means interposed between the first and second sensors and the computer means for converting the first and second signals from an analog type to a digital type signal. The computer means then periodically samples and compares the first and second signals with respect to a predetermined logic pattern and generates the correction signals responsive thereto.

BRIEF DESCRIPTION OF THE DRAWINGS

Other objects, features and advantages of the present invention will be apparent from a study of the written description and the drawings in which.

DETAILED DESCRIPTION OF THE PREFERRED EMBODIMENT

Figure 1:
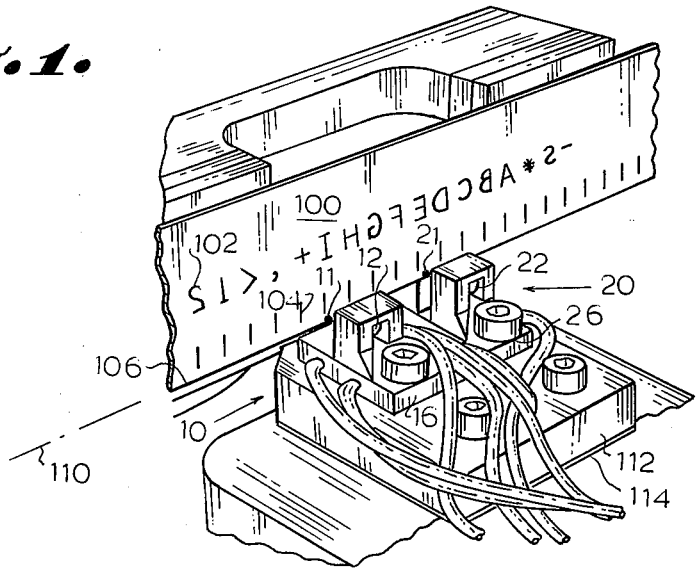
FIG. 1 illustrates a perspective view of the first second sensor assemblies positioned adjacent to the edge of the endless loop printing band.
Figure 2:
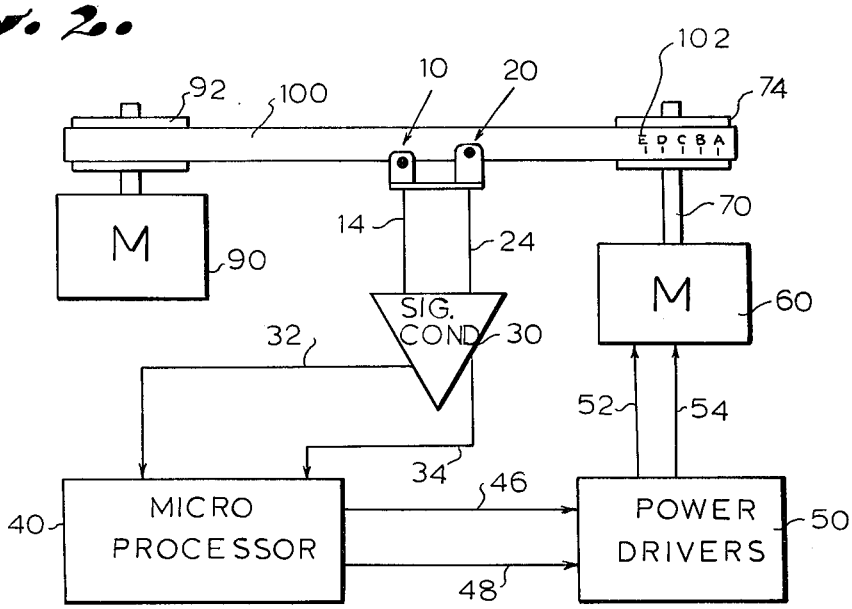
FIG. 2 illustrates a schematic block diagram of the band positioning apparatus.

A first preferred embodiment of the band positioning apparatus in accordance with the present invention is illustrated schematically in FIG. 2. As illustrated in FIGS. 1 and 2, a first sensor 10 comprises a first light source 11, an LED, and a first photodetector 12 aligned coaxially therewith but spaced on opposite sides of a lower edge section of an endless loop printing band 100. The printing band 100 includes thereon a plurality of character impressions 102 and a plurality of timing marks 104 paired therewith for signaling an impact hammer (not shown) to impact the character impressions 102 for imprinting the character on a paper adjacent thereto. The axis between the first light source 11 and the first photodetector 12 is displaced just below an edge surface 106 of the endless loop printing band 100. The preferred or nominal position of the edge surface 106 of the endless loop printing band 100 may be referred to as a reference line or reference position 110. As the edge surface 106 moves below the reference line 110, the transmission of light between the first light source 11 and the first photodetector 12 will be interrupted. A change in the light incident upon the first photodetector 12 will cause a signal to be transmitted down the circuit line 14 to a first input of a signal amplifier and conditioner 30.

A second sensor, illustrated generally as 20, comprises a second light source 21 and a second photosensitive detector 22 coaxially arranged adjacent to the edge surface 106 of the endless loop printing band 100. However, in contrast with the first sensor 10, the axis between the second light source 21 and the second photodetector 22 intersects the endless loop printing band 100 at a point just vertically above the edge surface 106 and the reference line 110, such that under normal conditions the light is not transmitted to the second photodetector 22. However, if the edge surface 106 of the endless loop band 100 drifts in a vertically upward direction, the light from the second light source 21 will be received by the second photodetector 22 causing a signal to be transmitted over the circuit conductor 24 coupled to a second input of the signal amplifier and conditioner 30.

The first sensor 10 and the second sensor 20 are each removably attached to a main frame 112 which in turn is coupled to the printer base 114. Each of the mounting plates 16 and 26 may be adjusted in height by placing shims thereunder. Also, the height of both the first and second sensors 10 and 20 may be simultaneously adjusted by inserting shims between the main frame 112 and the printer base 114. Generally, no axial alignment of the light source and the photodetector either of the first or second sensors are required since each element is rigidly mounted to a common mounting plate, 16 and 26 respectively.

The first signal received from the first sensor 10 and the second signal received from the second sensor 20 are separately conditioned and amplified in the signal amplifier and conditioner circuitry 30. The signal amplifier and conditioner 30 comprises well known circuitry for removing impulse and Gaussian noise from the first and second signals. The signal amplifier and conditioner circuitry 30 comprises an active network for digitizing the analog input signals. Each section of the circuit 30 provides a digital output representative of a one or a zero indication responsive to the respective input signals. The circuit 30 includes a hysteresis lag for time averaging the input signals.

The first signal is coupled from a first output of the signal amplifier and conditioner through a circuit conductor 32 to a first input of a microprocessing computer 40. The second signal is coupled from a second output of the signal amplifier and conditioner 30 through a second conductor 34 to a second input of the microprocessor 40.

The microprocessor 40 comprises a digital circuit having an internal clock for, among other things, comparing the first signal and the second signal at the respective inputs thereof to a preprogrammed logic table. For example, if each of the first and second sensors 10 and 20 generates a logic 1 responsive to receiving light from its paired light source, then the lower edge surface 106 of the endless loop printing band 100 will be in the correct position when the first signal is a 1 and the second signal is a 0. When the edge surface 106 lies above the reference line 110, then the first signal and the second signal will both be ones. When the edge surface 106 drifts below the reference line 110, both the first and second signals will be zeros. Of course, there is an allowable increment of movement of the edge surface 106 about the reference line 110 without actuating the microprocessor 40 to produce the error signal. This is caused by various mechanical and electrical inaccuracies including among others, the effective apertures of the first and second photodetectors 12 and 22, the electrical digitizing accuracy of the signal amplifier and conditioner 30 together with the sampling rate of the microprocessor 40. The microprocessor 40 is programmed to provide at an output thereof a correction signal responsive to the first and second input signals being compared with the preprogrammed logic table. In a first preferred embodiment of the present invention these correction signals comprise a plurality of parallel digital lines for carrying digital pulses of unit amplitude which are coupled from first outputs of the microprocessor 40 into first inputs of a power driver circuit 50 by first circuit lines 46. Generally, the digital signals are formatted as a "Johnson counter" signal which provides a digital indication of the magnitude and the direction of change required to bring the edge surface 106 back toward the reference line 110. Also, an enable line 48 is coupled from a second output of the microprocessor 40 to a second input of the power driver circuitry 50. The enable line 48 is actuated by the home pulse on the printing band, that is once per band revolution, for updating the correction or error signal subputs from the microprocessor 40. The periodic enable signal from a second output of the microprocessor 40 also reduces the power consumption of the power by the power driver circuitry.

The power driver circuitry 50 comprises standard power amplifier circuits for controlling the power applied through the circuit lines 52 and 54 to the stepping motor 60. As previously discussed, no power is applied to the stepping motor 60 unless the enable signal is received from the microprocessor 40.

Figure 3:
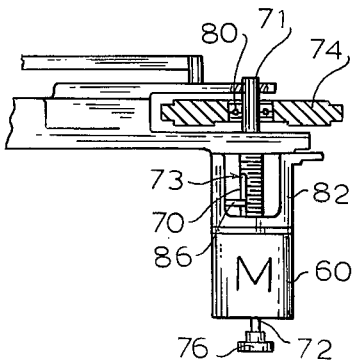
FIG. 3 illustrates a cross-section elevational view of the pulley and stepping motor assembly.
Figure 4:
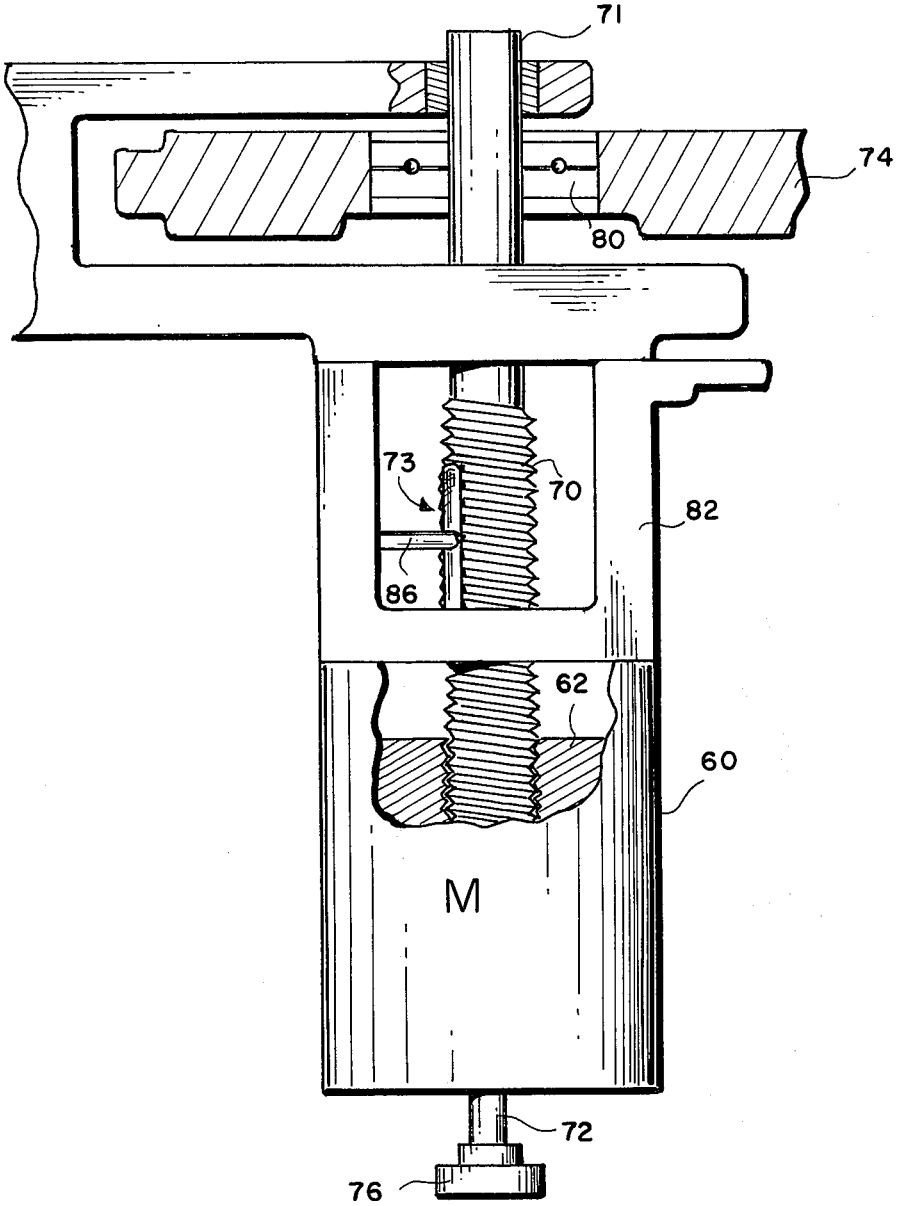
FIG. 4 shows a partially cutaway view of the stepping motor illustrating the threaded aperture.

The stepping motor 60 comprises a 4 phase electromechanical device for receiving the amplified correction signals, which have a Johnson counter digital format, through the circuit conductors 52 and 54 and responsive thereto incrementally varying the neight of a lead screw 70. The height is adjusted by one increment during each revolution of the printing band 100. As illustrated in FIG. 3, the lead screw 70, having an idler pulley 74 coupled thereto, communicates coaxially through the stepping motor 60 as seen in the cutaway view of stepping motor 60 of FIG. 4. A first end of the lead screw extends through a captured bearing 80 which in turn is coupled coaxially to the idler pulley 74. The distended end 71 of the lead screw 70 coupled to the stepping motor 60 communicates through an aperture in a reinforcing bar positioned above the idler pulley 74. The idler pulley 74 rotates freely about the bearing 80 but is not free to move longitudinally along the lead screw 70. A center section of the lead screw 70 includes therein a plurality of threads for being engaged by the sides of a threaded aperture within the stepping motor 60. The lead screw 70 includes through the center section thereof a longitudinal slot 73. A pin 86 coupled to the fixed frame 82 communicates within the longitudinal slot 73 for preventing the rotation of the lead screw 70 about its longitudinal axis. In this manner, when the stepping motor 60 is actuated, the motor assembly will engage the lead screw 70 and move the center threaded section in either an upward or downward direction depending upon the correction signal provided thereto. The second end 72 of the lead screw 70 includes thereon a manually operated handle for initially adjusting the edge surface 106 of the endless loop printing band 100 with respect to the reference line 110.

The operation of the band positioning apparatus in accordance with the present invention will now be explained with reference to FIGS. 2 and 3. First, power is applied to a drive motor 90 having coupled thereto a drive pulley 92 for driving at high speed the endless loop printing band 100. After the endless loop printing band 100 has achieved its operational speed, the operator adjusts the handle 76 coupled to the lead screw 70 for positioning the lower edge surface 106 of the endless loop printing band 100 within an accepted tolerance limit of the reference line 110. As long as the edge surface 106 stays within the tolerance limits adjacent the reference line 110, the band positioning system will be generally inoperative. However, if the edge surface 106 of the endless loop printing band 100 drifts above the reference line 110 by a distance exceeding the predetermined tolerance level, the first and second signal inputs to the microprocessor 40 will both be 1, since both the first and second photodetectors 12 and 22 will receive the light from their paired light sources 11 and 21 respectively. The microprocessor 40 will periodically compare the first and second input signals with the preprogrammed logic table and responsive to these signals will generate the correction signals to the power driver circuitry 50. This correction signal will be correct in both direction and amplitude for actuating the stepping motor 60 to drive the edge surface 106 of the endless loop printing band 100 back toward the reference line 110. However, power will be provided from the power drive circuitry 50 to the stepping motor 60 only periodically during one revolution of the printing band 100 for incrementally actuating the stepping motor 60. Generally, the power driver circuitry 50 is actuated only once per revolution of the printing band 100 by the passage of a home signal past a reference point. The power driver circuitry 50 will drive the stepping motor 60 in the proper rotational direction to retract the length of the lead screw 70. Since the idler pulley 74 is coupled to the first end 71 of the lead screw 70, the idler pulley 74, having the endless loop printing band 100 coupled thereto, will be drawn in a downward direction, thereby forcing the edge surface 106 into the predetermined tolerance limits adjacent the reference line 110. If further incremental correction is required, it will be initiated during the next actuating period. In a similar manner the band positioning apparatus will drive the idler pulley 74 in a vertical direction to compensate for the edge surface 106 deviating below the reference line 110 beyond the allowable incremental distance.

Thus, a first preferred embodiment of a band positioning apparatus has been discussed as an example of the invention as claimed. However, the present invention should not be limited in its application to the details illustrated in the accompanying drawings and the specification since this invention may be practiced and constructed in a variety of different embodiments. Also, it must be understood that the terminology and descriptions employed herein are used solely for the purpose of describing the general operation of the preferred embodiment and should not be construed as limitations on the operability of the invention.

I claim:

1. A band positioning apparatus for positioning a high speed endless loop printing band of the type used on impact band printers, along an axis perpendicular to the direction of feed, said apparatus comprising in combination:

at least one pulley having a high speed endless loop printing band riding thereon;

a first sensor for generating at an output thereof a first signal responsive to an edge of the endless loop printing band drifting to one side of a reference line, with said reference line being parallel to and defined by the preferred position of an edge of the endless loop printing band;

a second sensor for generating at an output thereof a second signal responsive to the edge of the endless loop printing band drifting to the other side of said reference line;

computer means having a first input coupled to said output of said first sensor and a second input coupled to said output of said second sensor, said computer means for generating at an output thereof correction signals responsive to receiving and comparing said first and second signals; and step motor means coupled to said pulley for moving said pulley and the endless loop printing band toward said reference line responsive to receiving said correction signals coupled to an input of said step motor means from said computer means.

2. The band positioning apparatus as described in claim 1, wherein said first sensor comprises in combination:

a first light source and a first photodetector spaced on opposite sides of the endless loop printing band, with said first photodetector generating said first signal responsive to the edge of said endless loop printing band obstructing the transmission of light from said first light source; and wherein said second sensor is positioned generally adjacent said first sensor and comprises:

a second light source and a second photodetector spaced on opposite sides of said endless loop printing band, with said second photodetector generating said second signal responsive to detecting light from said second light source.

3. The band positioning apparatus as described in claim 2, further comprising conditioning means interposed between said output of said first sensor and said first input of said computer means, and between said output of said second sensor and said second input of said computer means, said contioning means for converting each of said first and second signals from an analog type signal to a digital type pulse signal.

4. The band positioning apparatus as described in claim 3, wherein said computer means compares said first signal and said second signal to a preprogrammed logic pattern stored therein.

5. The band positioning apparatus as described in claim 4, wherein said correction signals comprise:

a first correction signal generated by said computer means responsive to the reception of said first signal and the absence of said second signal; and a second correction signal generated by said computer means responsive to the reception of said second signal and the absence of said first signal.

6. The band positioning apparatus as described in claim 5, wherein said correction signals further comprise an enable signal generated by said computer means responsive to the longitudinal progression of the endless loop printing band.

7. The band positioning apparatus as described in claim 6, wherein said computer means comprises digital microprocessor means for periodically sampling said first and second signals and for generating said correcting signals responsive thereto.

8. The band positioning apparatus as described in claim 7, wherein said correction signals are digital pulse signals generated responsive to said periodic sampling of said computer means.

9. The band positioning apparatus as described in claim 8, further comprising power driver means interposed between said output of said computer means and said input of said step motor means for amplifying and coupling said correction signals to said step motor means responsive to receiving said enable signal from said computer means.

10. The band positioning apparatus as described in claim 2, wherein said pulley is an idler pulley having a circumferential surface thereof in guiding communication with said endless loop printing band; and a lead screw is coaxially coupled to said idler pulley by bearing means coupled therebetween, whereby said lead screw may independently rotate and move said idler pulley in a direction generally perpendicular to said reference line; and said stepping motor means has a stepping motor having an input thereof coupled to said output of said computer means for controlling the longitudinal extension of said lead screw responsive to said correction signals, with said stepping motor having a rotatable threaded section for engaging and rotably extending said lead screw.

11. The band positioning apparatus as described in claim 10, wherein said idler pulley is paired with a drive pulley, with said idler pulley and said drive pulley each located at opposite ends of the endless loop printing band.

12. The band positioning apparatus as described in claim 11, further including manual adjusting means coupled to said lead screw for manually adjusting the position of the edge of the endless loop printing band.

13. The band positioning apparatus as described in claim 10, wherein said stepping motor is a four phase incremental stepping motor and wherein said correction signals are digital format type signals, with said stepping motor being of the self-locking type during non-driven periods.

14. A band position detection apparatus for generating a correction signal correlated to the position of a high speed endless loop printing band of the type used on impact band printers, along an axis perpendicular to the direction of feed, said apparatus comprising in combination:

at least one pulley having a high speed endless loop printing band riding thereon;

a first sensor for generating at an output thereof a first signal responsive to an edge of the endless loop printing band drifting to one side of a reference line, with said reference line being parallel to and defined by the preferred position of an edge of the endless loop printing band;

a second sensor for generating at an output thereof a second signal responsive to the edge of the endless loop printing band drifting to the other side of said reference line, and computer means having a first input coupled to said output of said first sensor and a second input coupled to said output of said second sensor, said computer means for generating at an output thereof correction signals responsive to receiving and comparing said first and second signals.

15. The band position detection apparatus described in claim 14, wherein said first sensor comprises in combination:

a first light source and a first photodetector spaced on opposite sides of the endless loop printing band, with said first photodetector generating said first signal responsive to the edge of said endless loop printing band obstructing the transmission of light from said first light source; and wherein said second sensor is positioned generally adjacent said first sensor and comprises:

a second light source and a second photodetector spaced on opposite sides of said endless loop printing band, with said second photodetector generating said second signal responsive to detecting light from said second light source.

16. The band position detection apparatus as described in claim 15, further comprising conditioning means interposed between said output of said first sensor and first input of said computer means, and between said output of said second sensor and said second input of said computer means, said conditioning means for converting each of said first and second signals from an analog type signal to a digital type pulse signal.

17. The band position detection apparatus as described in claim 16, wherein said computer means compares said first signal and said second signal to a preprogrammed logic pattern stored therein.

18. The band position detection apparatus as described in claim 17, wherein said correction signal comprises:

a first correction signal generated by said computer means responsive to the reception of said first signal and the absence of said second signal; and a second correction signal generated by said computer means responsive to the reception of said second signal and the absence of said first signal.

19. The band position detection apparatus as described in claim 18, wherein said computer means for periodically sampling said first and second signals and for generating said correcting signals responsive thereto.

20. The band position detection apparatus as described in claim 19, wherein said correction signals are digital pulse signals generated responsive to said periodic sampling of said computer means.

* * * * *